United States Patent [19]

Johnson et al.

[11] Patent Number: 4,460,452

[45] Date of Patent: Jul. 17, 1984

[54] PROCESS FOR SEPARATING CRUDE OIL FROM MIXTURES COMPRISING FINELY DIVIDED INORGANIC SOLIDS, CRUDE OIL, AND WATER

[75] Inventors: Steven W. Johnson, Plano; Robert H. Smith, Katy, both of Tex.

[73] Assignee: Atlantic Richfield Company, Los Angeles, Calif.

[21] Appl. No.: 395,512

[22] Filed: Jul. 6, 1982

[51] Int. Cl.[3] ..... C10G 1/04

[52] U.S. Cl. ..... 208/11 LE; 208/8 LE

[58] Field of Search ..... 208/8 R, 8 LE, 11 R, 208/11 LE

[56] References Cited

U.S. PATENT DOCUMENTS

| | | | |
|---|---|---|---|
| 3,131,141 | 4/1964 | West | 208/11 LE |
| 4,139,450 | 2/1979 | Hanson et al. | 208/11 LE |
| 4,167,470 | 9/1979 | Karnofsky | 208/11 LE |

OTHER PUBLICATIONS

Cottrell, "Development of an Anhydrous Process for Oil-Sand Extraction", Research Council of Canada, (10/1963).

*Primary Examiner*—Delbert E. Gantz
*Assistant Examiner*—A. Pal
*Attorney, Agent, or Firm*—F. Lindsey Scott

[57] ABSTRACT

A process for separating crude oil from a mixture comprising crude oil, finely divided organic solids and water by contacting the mixture with a solvent and a solvent vapor stream in a first contacting zone to heat the mixture and produce a vaporous stream containing at least a major portion of the water and a crude oil laden solvent and inorganic solids mixture which is thereafter separated into a crude oil laden solvent stream and an inorganic solids stream with the inorganic solids stream being thereafter contacted with additional solvent to remove additional quantities of crude oil from the inorganic solids. Crude oil is recovered from a crude oil laden solvent stream.

10 Claims, 1 Drawing Figure

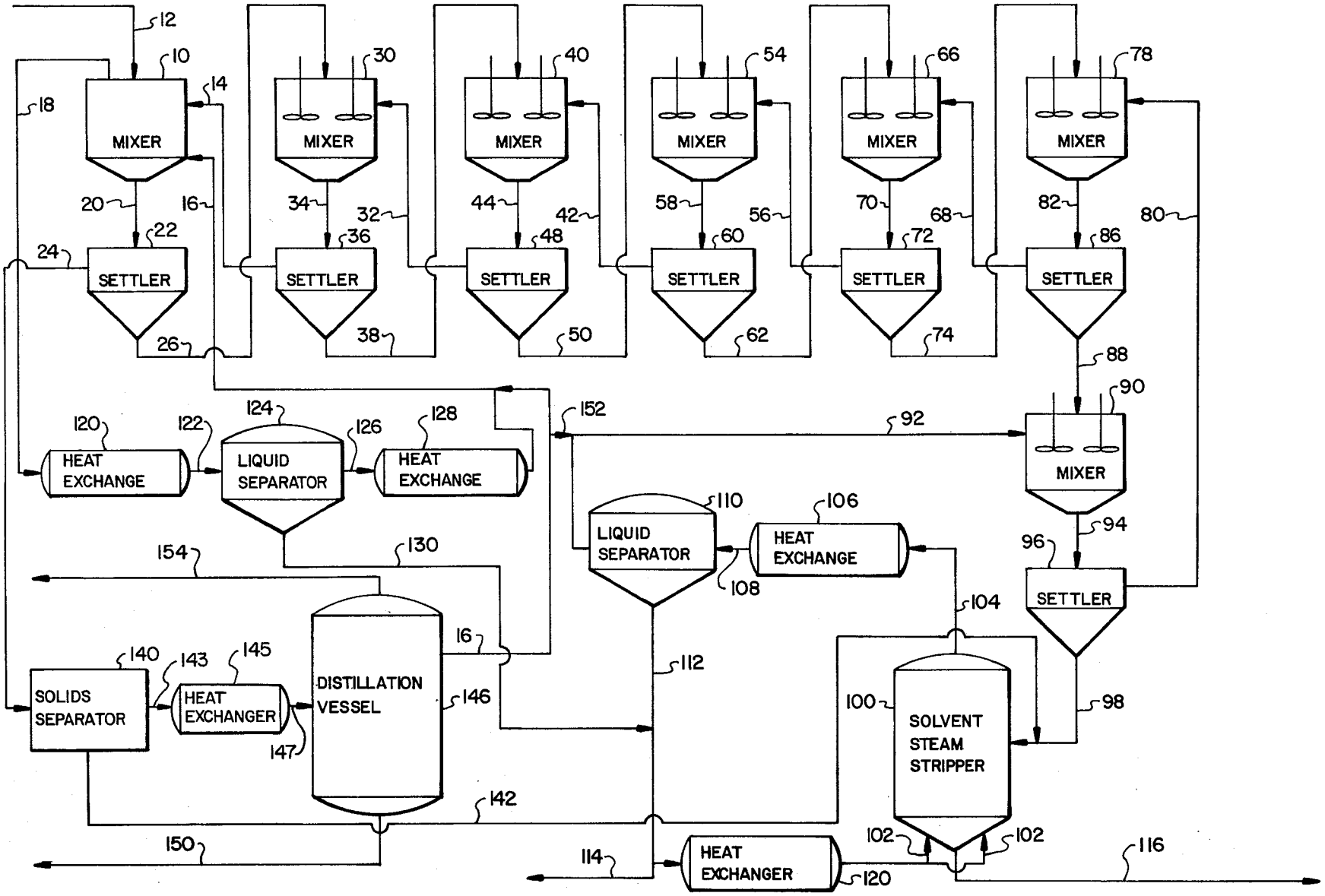
MIXER
SETTLER
SOLVENT STEAM STRIPPER
HEAT EXCHANGE
LIQUID SEPARATOR
HEAT EXCHANGER
DISTILLATION VESSEL
SOLIDS SEPARATOR

PROCESS FOR SEPARATING CRUDE OIL FROM MIXTURES COMPRISING FINELY DIVIDED INORGANIC SOLIDS, CRUDE OIL, AND WATER

This invention relates to methods for recovering crude oil from mixtures comprising finely divided inorganic solids, crude oil, and water.

This invention further relates to an improved process for separating crude oil from mixtures comprising finely divided inorganic solids, crude oil, and water by the use of countercurrent solvent contacting.

In recent years, the search for additional supplies of crude oil has led to the investigation of processes for the recovery of crude oil from sources such as tar sands, oil shales, heavy oil deposits, and the like. One deposit which has been of considerable interest as a source of crude oil is a field containing large deposits of crude oil in mixture with diatomaceous earth near Bakersfield, Calif. The deposits are generally referred to as the McKittrick Oil Field. These deposits are relatively shallow and contain substantial quantities of crude oil in mixture with diatomaceous earth solids and minor quantities of water.

The term "crude oil" as used in the description of the present invention encompasses oleaginous materials such as those found in the McKittrick Oil Field deposits, oil shales, tar sands, heavy oil deposits, and the like. For convenience the term crude oil is used to refer to such oleaginous materials generally, since the materials contained in such deposits are much more oleaginous in nature than other types of hydrocarbonaceous deposits such as coal of various grades, and the like.

In the recovery of crude oil from such materials, a continuing problem is the cost involved in handling the solid material and extracting the crude oil therefrom. Many processes have been proposed for the recovery of crude oil from tar sands, oil shale, and the like. The problems associated with such materials are somewhat different than those associated with the recovery of crude oil from the McKittrick Field deposits since the crude oil in the McKittrick Field deposits apparently is not chemically bound to the diatomaceous earth or locked in position, but rather is apparently in place as crude oil which is readily removed by suitable solvents from the diatomaceous earth solids.

In the recovery of such crude oil, it has been observed that solvent extraction is effective to recover the crude oil from the diatomaceous earth deposits when water has been removed from the mixture. Unfortunately, water occurs in the mixture to varying degrees, thus inhibiting the recovery of the crude oil by simple solvent extraction processes. Thermal processes have been proposed for distilling the crude oil from the solids by a process proposed by Lurgi Mineroltechnik GmbH, Frankfurt. A further process directed to the recovery of the crude oil from such deposits has been proposed by Dravo Corporation of Pittsburgh, Pa. These processes are described in an article published Jan. 18, 1982 in the Oil and Gas Journal entitled "Getty to tap heavy oil in diatomite". A further reference disclosing additional information with respect to the Getty process is an article entitled "Tapping Diatomite Crude" published by Getty Oil Company, 1981. The Dravo process as described in the articles uses a solvent composed of heptane, cyclohexane, and ethanol. It is disclosed in the articles that various evaporation processes are required to separate the respective streams recovered in the Dravo process.

It is noteworthy that the Lurgi process requires substantial inputs of thermal energy and that the Dravo process requires the use of solvents which do not appear to be process-derived solvents, i.e., heptane, cyclohexane, and ethanol. As a result, the expense associated with the practice of these processes appears to be substantial.

As a result of the continuing interest in the recovery of crude oil from such deposits, a continuing effort has been directed to the development of improved processes for the recovery of crude oil from mixtures containing crude oil in combination with finely divided inorganic solids and water.

It has now been found that an improved process for separating crude oil from such mixtures consists essentially of contacting the mixture with a process-derived solvent, the solvent having a boiling point from about 200° to about 400° F. (about 90° to about 210° C.) at one atmosphere pressure to dissolve at least a portion of the crude oil from the mixture, and a vaporous stream of solvent in an amount sufficient to heat the mixture and the solvent in a first contact zone to produce a vaporous stream containing at least a major portion of the water in the mixture and a first crude oil laden solvent and inorganic solids mixture; separating at least a major portion of the inorganic solids from a major portion of a first crude oil laden solvent stream to produce a first separated inorganic solids stream and a first crude oil laden solvent stream; mixing the separated inorganic solids with a quantity of solvent in a second contact zone to dissolve additional quantities of the crude oil from the inorganic solids and produce a second crude oil laden solvent and inorganic solids mixture from which at least a major portion of the inorganic solids are recovered to produce a second inorganic solids stream and a second crude oil laden solvent stream with crude oil thereafter being recovered from at least one of the crude oil laden solvent streams.

FIG. 1 is a schematic diagram of an embodiment of the process of the present invention.

In general, the process of the present invention comprises contacting a mixture containing crude oil, finely divided inorganic solids, and water with a suitable process-derived solvent and solvent vapor in a first contacting zone to remove at least a major quantity of the water as a vaporous stream from the first contacting zone. The temperature in the first contacting zone is desirably from about 175° to about 250° F. (about 80° to about 120° C.). The residence time is a time suitable to accomplish the removal of a desired quantity of the water present initially in the mixture and to result in the removal of a desired quantity of the crude oil from the inorganic solids contained in the mixture. The residence time and temperature can vary widely depending upon the operating temperature, the quantities of solvent vapor charged, the quantities of water initially present in the mixture, the amount of crude oil to be dissolved from the inorganic solids in the first contacting zone, and the like as known to those skilled in the art. In general, it is believed that suitable operating temperatures will be from about 175° to about 250° F. at one atmosphere pressure, although the process can be operated at higher temperatures at elevated pressure if desired. Desirably, at least about 90 weight percent of the water initially present in the mixture is removed in the first contacting zone. The amount of crude oil dissolved from the inorganic solids in the first contacting zone is less critical and can vary widely.

The mixture recovered from the first contacting zone which comprises finely divided inorganic solids in mixture with a crude oil laden solvent and any residual quantities of water is recovered and separated into a finely divided inorganic solids stream and a crude oil laden solvent stream. The finely divided inorganic solids are thereafter subjected to additional solvent contacting to remove additional quantities of crude oil from the inorganic solids. Crude oil is ultimately recovered from at least one of the crude oil laden solvent streams.

In FIG. 1, an embodiment of the process of the present invention is shown. A mixture containing crude oil, finely divided inorganic solids, and water is charged to a first mixer 10 through a line 12. A solvent stream is charged to first mixer 10 through a line 14 with solvent vapor being charged to first mixer 10 through a line 16. A vaporous overhead stream containing water and solvent vapor is recovered through a line 18 with a mixture comprising inorganic solids and crude oil laden solvent being recovered through a line 20. It will be noted that first mixer 10 contains no mechanical mixing means since it is contemplated that adequate mixing will be accomplished in first mixer 10 by the injection of solvent vapor through line 16 into the lower portion of first mixer 10. The stream recovered through line 20 is passed to a first settler 22 where a stream comprising crude oil laden solvent is recovered through a line 24 with an inorganic solids stream being recovered through a a line 26. The inorganic solids stream recovered through line 26 is passed to a second mixer 30 where it is contacted with an additional quantity of solvent charged to second mixer 30 through a line 32 to produce a mixture which is recovered through a line 34 and passed to a second settler 36. A crude oil laden solvent stream is recovered from second settler 36 through line 14 and constitutes solvent charged to first mixer 10. An inorganic solids stream is recovered from second settler 36 through a line 38 and passed to a third mixer 40 where it is contacted with an additional quantity of solvent charged to third mixer 40 through a line 42 to produce a mixture which is recovered through a line 44 and passed to a third settler 48. In third settler 48 a crude oil laden solvent stream is recovered through a line 32 with an inorganic solids stream being recovered through a line 50 and passed to a fourth mixer 54 where it is contacted with solvent from a line 56 to produce a mixture which is recovered through a line 58 and passed to a fourth settler 60. In fourth settler 60 the mixture is separated into a crude oil laden solvent stream which is recovered through line 42 and an inorganic solids stream which is recovered through a line 62 and passed to a fifth mixer 66 where it is contacted with solvent passed to fifth mixer 66 through a line 68 to produce a mixture which is recovered through a line 70 and passed to a fifth settler 72. In fifth settler 72 a crude oil laden solvent stream is recovered through line 56 with an inorganic solids stream being recovered through a line 74 and passed to a sixth mixer 78 where it is mixed with solvent charged to sixth mixer 78 through a line 80 to produce a mixture which is recovered through a line 82 and passed to a sixth settler 86. A crude oil laden solvent stream is recovered from sixth settler 86 through line 68 with an inorganic solids stream being recovered through a line 88 and passed to a seventh mixer 90 where it is mixed with solvent which is passed to seventh mixer 90 through a line 92 to produce a mixture which is recovered through a line 94 and passed to seventh settler 96. A crude oil laden solvent stream is recovered from seventh settler 96 through a line 80 with an inorganic solids stream which contains minor quantities of crude oil being recovered through a line 98 and passed to a solvent steam stripping vessel 100. Steam is charged to vessel 100 through lines 102 to remove residual quantities of solvent and crude oil from the inorganic solids with the solvent and crude oil being recovered as a vaporous stream through a line 104. The inorganic solids from which substantially all the crude oil and solvent have been removed are discharged from vessel 100 through a line 116 and may be used as land fill and the like. There should be no substantial environmental problem in using such inorganic solids for land fill since any crude oil constituents remaining with such inorganic solids are merely a portion of the organic material initially present in the natural environment from which the mixture charged to the process was taken. The vaporous stream recovered from vessel 100 through line 104 is passed through a heat exchanger 106 to produce a liquid stream which is passed through a line 108 to a liquid separator 110. In liquid separator 110 a solvent stream is recovered through a line 92 and passed to seventh mixer 90. Water is recovered from liquid separator 110 through a line 112 and may be used to generate steam in heat exchanger 120 for use in solvent steam stripper 100 or passed to discharge through a line 114. It is recognized that water passed to discharge through line 114 may require processing to produce water of a quality suitable for discharge, but no novelty is considered to reside in the treatment of this water stream, so no further discussion is deemed necessary.

It will be noted that in general the process as set forth, while it involves a plurality of mixers and settlers, in essence comprises a plurality of countercurrent contacting stages for the extraction of crude oil from the inorganic solids. In many instances it may not be necessary to use more than one such step, whereas in other instances it may be necessary to use a large number of steps. The temperature and residence time in such mixing and settling steps will be determined primarily by the properties of the particular solvent chosen and the crude oil to be extracted. Similarly, the residence time in the settlers will be determined primarily by the settling properties of the particular solids in the liquids present in the settlers. Such determinations are well within the skill of those in the art given the specific streams involved.

The vaporous stream recovered from first mixer 10 through line 18 comprises water vapor and solvent vapor. Clearly, minor quantities of crude oil, or volatile constituents of the crude oil, may be recovered with this stream as well as minor quantities of entrained liquids. The stream is passed through a heat exchanger 120 where it is cooled to produce a liquid stream which is passed to a liquid separator 124. In liquid separator 124 a solvent stream is recovered through a line 126 and passed to a heat exchanger 128 where it is vaporized to produce solvent vapor for return to first mixer 10. Clearly, it may be necessary to remove volatile constituents from liquid separator 124 as required in the event that the crude oil contains, or produces as a result of the treatment in first mixer 10, volatile constituents such as light hydrocarbons and the like. Such materials may be recovered and passed to recovery or flared as known to those skilled in the art. In other words, it may not be practical to recover such volatile materials if they are produced in minor quantities, whereas in the event that substantial quantities are produced, it may be practical to recover such materials for further processing to yield valuable fuels. Similarly, it may be necessary to periodically recover liquids from heat exchanger 128 in the event that substantial quantities of crude oil are entrained in the stream recovered through line 18. Such process variations are well known to those skilled in the art and have not been shown. The primary constituents of the stream recovered through line 18 are water and solvent vapor which are normally separated as described in liquid separator 124. Water is recovered from liquid separator 124 through a line 130 and may be passed to line 112 for treatment with the stream contained in line 112. In most instances, it is contemplated that the practice of the process of the present invention will result in the production of substantial quantities of water for discharge as described through line 114. The stream recovered through line 24 from first settler 22 is passed to a solids separator 140 where solids are separated from the crude oil laden solvent stream. The amount and type of solids contained in this stream will vary substantially depending upon the particular mixture charged initially to first mixer 10. The solids are desirably separated by filtration, disc nozzle separators, hydroclones, or the like, as known to those skilled in the art. The solids so recovered are passed through a line 142 to treatment in solvent steam stripper 100, as described previously. The crude oil laden solvent stream is passed through a line 143 to a heat exchanger 145 and then through a line 147 to a distillation vessel 146 where crude oil is separated from the solvent with the crude oil being recovered through a line 150 and the solvent being recovered through line 16. Light hydrocarbonaceous materials and other light constituents may be recovered through line 154 and passed to further processing, to flaring, or the like. The solvent recovered through line 16 may be recycled to first mixer 10, or condensed and passed to seventh mixer 90 or other mixers. As shown in the FIGURE, a portion of the solvent is condensed (heat exchanger not shown) and passed through a line 152 to seventh mixer 90. In the practice of the method of the present invention it is contemplated that considerable variation of the quantities of material flowing in the various lines may be necessary depending upon the particular mixture charged to first mixer 10, the particular solvent used, and the like. Such variations are well known to those skilled in the art and need not be discussed further.

The solvent used is a process-derived solvent and comprises primarily paraffinic hydrocarbons boiling in a temperature range of from about 100° to about 400° F. (about 38° to about 205° C.) at one atmosphere pressure. Preferably the temperature is from about 200° to about 300° F. (about 90° to about 150° C.). It is believed that most crude oils recovered by such processes will contain substantial quantities of such material. In the event that such is the case, more than enough solvent should be produced by the practice of the process to make up process losses of solvent and to produce a net make of solvent.

By the practice of the present invention, a primary disadvantage of countercurrent solvent contacting of mixtures of crude oil, inorganic solids, and water has been overcome, i.e., in first mixer 10 a step is provided whereby substantially all the water is removed from the mixture so that solvent contacting in subsequent mixing zones is more effective. As a net result, mixtures of inorganic solids, crude oil, and water can be effectively separated by the process of the present invention without the need for special solvent mixtures which require involved separation techniques and expensive solvent make up from sources extraneous to the process. Further, the process is relatively straightforward and involves no complex operations to produce an effective separation of crude oil from the mixtures. The mixing in mixers other than first mixer 10 may be by any suitable mechanical means. The means of agitation is not considered to be critical, nor is residence time or temperature. These variables will of necessity be fixed by the number of mixing and settling stages used, the particular crude oil to be recovered, the solvent, and a multitude of other variables which can only be determined with precision after the particular feedstock and solvent are identified. In general, it is contemplated that the mixers will be operated at atmospheric pressure or, in the case of first mixer 10, possibly at a slight positive pressure to facilitate the recovery of the vaporous stream recovered through line 18.

It is further noted that in the practice of the process described in the FIGURE, various pumps, compressors, and other handling equipment not shown, will be required to facilitate the flow of streams as shown. In particular, heat exchange between various of the process streams may be desirable for energy optimization.

Having thus described the invention by reference to certain of its preferred embodiments, it is respectfully pointed out that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, we claim:

1. A process for separating crude oil from mixtures consisting essentially of diatomaceous earth solids, said crude oil, and water, said process consisting essentially of:

(a) contacting said mixture with a paraffinic process-derived solvent stream to dissolve at least a portion of said crude oil from said mixture and a vaporous stream of said solvent in an amount sufficient to heat said mixture and said solvent in a contact zone to produce a vaporous stream containing at least a major portion of the water in said mixture and a first crude oil laden solvent and inorganic solids mixture;

(b) separating said vaporous stream containing said major portion of the water in said mixture from said mixture;

(c) separating at least a major portion of said inorganic solids from a major portion of said first crude oil laden solvent and inorganic solids mixture to produce a first inorganic solids stream and a first crude oil laden solvent stream; and, (d) separating said crude oil from at least a major portion of said solvent in said first crude oil laden solvent stream.

2. The process of claim 1 wherein said vaporous stream containing at least a major portion of the water in said mixture in said contacting zone comprises vaporous water and solvent and wherein said solvent is recovered from said vaporous stream.

3. The process of claim 1 wherein said first inorganic solids stream is mixed with a quantity of said solvent in a mixing zone to dissolve additional quantities of said crude oil from said inorganic solids and produce a second crude oil laden solvent and inorganic solids mixture; at least a major portion of said inorganic solids is separated from a major portion of said crude oil laden solvent in said second crude oil laden solvent and inorganic solids mixture to produce a second inorganic solids stream and a second crude oil laden solvent stream; and said crude oil is separated from at least a major portion of said solvent in at least one of said crude oil laden solvent streams.

4. The process of claim 3 wherein a plurality of mixing zones and separation steps are used to dissolve said crude oil from said inorganic solids.

5. The process of claim 4 wherein at least a portion of said solvent recovered from at least one of said crude oil laden solvent streams is recycled to one of said mixing zones.

6. The process of claim 1 wherein the boiling point of said solvent is from about 200° to about 300° F.

7. In a process for separating crude oil from a mixture consisting essentially of diatomaceous earth solids, said crude oil, and water by contacting said mixture with a paraffinic process derived solvent to produce a crude oil laden solvent which is thereafter separated from said inorganic solids and separated into a crude oil stream and a solvent stream, an improvement comprising; contacting said mixture in a first contact zone with a stream of said solvent and a solvent vapor stream to heat said mixture and produce a vaporous stream containing at least a major portion of the water in said mixture and a crude oil laden solvent and inorganic solids mixture, said vaporous stream thereafter being separated from said mixture, and said crude oil ladent solvent and inorganic solids mixture being thereafter separated into an inorganic solids stream and a crude oil laden solvent stream.

8. The process of claim 7 wherein said solvent has a boiling point at one atmosphere pressure from about 100° to about 400° F.

9. The process of claim 8 wherein a plurality of contact zones and contacting and separation steps are used to remove additional quantities of crude oil from said inorganic solids stream.

10. The process of claim 9 wherein said crude oil is separated from a crude oil laden solvent stream from at least one of said contacting zones.

* * * * *